US005795532A

United States Patent [19]

Wagner et al.

[11] Patent Number: 5,795,532

[45] Date of Patent: Aug. 18, 1998

[54] METHOD FOR MAKING A MAGNETIC ROLL

[75] Inventors: Jennifer R. Wagner; Moritz P. Wagner, both of Walworth; Jorge A. Alvarez, Webster; David C. Irving, Avon, all of N.Y.

[73] Assignee: Xerox Corporation, Stamford, Conn.

[21] Appl. No.: 835,574

[22] Filed: Apr. 9, 1997

[51] Int. Cl.[6] ..... H01F 1/02

[52] U.S. Cl. ..... 264/429; 264/259

[58] Field of Search ..... 264/427, 429, 264/259

[56] References Cited

U.S. PATENT DOCUMENTS 5,181,971 1/1993 Ohtsuka ..... 148/103

5,319,337 6/1994 Matsunari et al. ..... 335/303

*Primary Examiner*—Christopher A. Fiorilla

*Attorney, Agent, or Firm*—Lloyd F. Bean, II

[57] ABSTRACT

A method for manufacturing a magnetic roll, including the steps of: molding a roll core with ferrite filled resin material to a first diameter; allowing the ferrite filled resin material to become hard; overmolding said roll core with ferrite filled resin material to a second diameter; and cooling the ferrite filled resin material until it becomes hard. The core is magnetized during said molding step and said overmolding step. The method may further include enclosing the core within a sleeve.

6 Claims, 6 Drawing Sheets

METHOD FOR MAKING A MAGNETIC ROLL

BACKGROUND OF THE PRESENT INVENTION

The invention relates generally to an electrophotographic printing machine and, more particularly, to a method for making a magnetic roll having improved magnetic properties.

This application incorporates co-pending application entitled "IMPROVED DEVELOPER ROLL" Application serial number (D/96584Q).

Generally, an electrophotographic printing machine includes a photoconductive member which is charged to a substantially uniform potential to sensitive the surface thereof. The charged portion of the photoconductive member is exposed to a light image of an original document being reproduced. This records an electrostatic latent image on the photoconductive member corresponding to the informational areas contained within the original document. After the electrostatic latent image is formed on the photoconductive member, the image is developed by bringing a developer material into contact therewith. Generally, the developer material comprises toner particles adhering triboelectrically to carrier granules. The toner particles are attached to the latent image from the carrier granules to form a powder image on the photoconductive member which is subsequently transferred to a copy sheet. Finally, the copy sheet is heated to permanently affix the powder image thereto in image configuration.

Development can be accomplished by the use of a magnetic brush. The magnetic brush is typically in the form of a cylindrical sleeve which rotates around a fixed assembly of permanent magnets. When utilizing magnetic brush-type development, the cylindrical sleeve is typically made of an electrically conductive, non-ferrous material, for example, aluminum.

These systems use a rotating sleeve with a passive magnetic pole pattern which provides the gradients that attract magnetic carrier to the sleeve. The developer is then transported around the developer roll and presented to the photoreceptor. .

Magnetic rollers can be made by injection molding a plastic resin highly filled with ferrites into a cylindrical cavity. The roller is magnetized during the molding cycle by strategically positioned permanent magnets located behind the cavity wall. One drawback of this process is that the resultant flux density produced outside the magnetic roller does not reach its full potential. The reason for this is that the internal layers of the bonded magnet are farther away from the magnetizing permanent magnets than the external layers and are not fully saturated. One method currently used to improve magnetic field strength is to demagnetize the newly molded magnet and then remagnetize using an electromagnetic fixture. This requires costly equipment and additional part handling.

SUMMARY OF THE INVENTION

Briefly, the present invention obviates the problems noted above by utilizing a method for manufacturing a developer roll, including the steps of: molding a roll core with ferrite filled resin material to a first diameter; allowing ferrite filled resin material to become hard; over molding said roll core with ferrite filled resin material to a second diameter; and ferrite filled resin material until it becomes hard; magnetizing said core during said molding step; and magnetizing said core during overmolding step.

DESCRIPTION OF THE INVENTION

Figure 1:
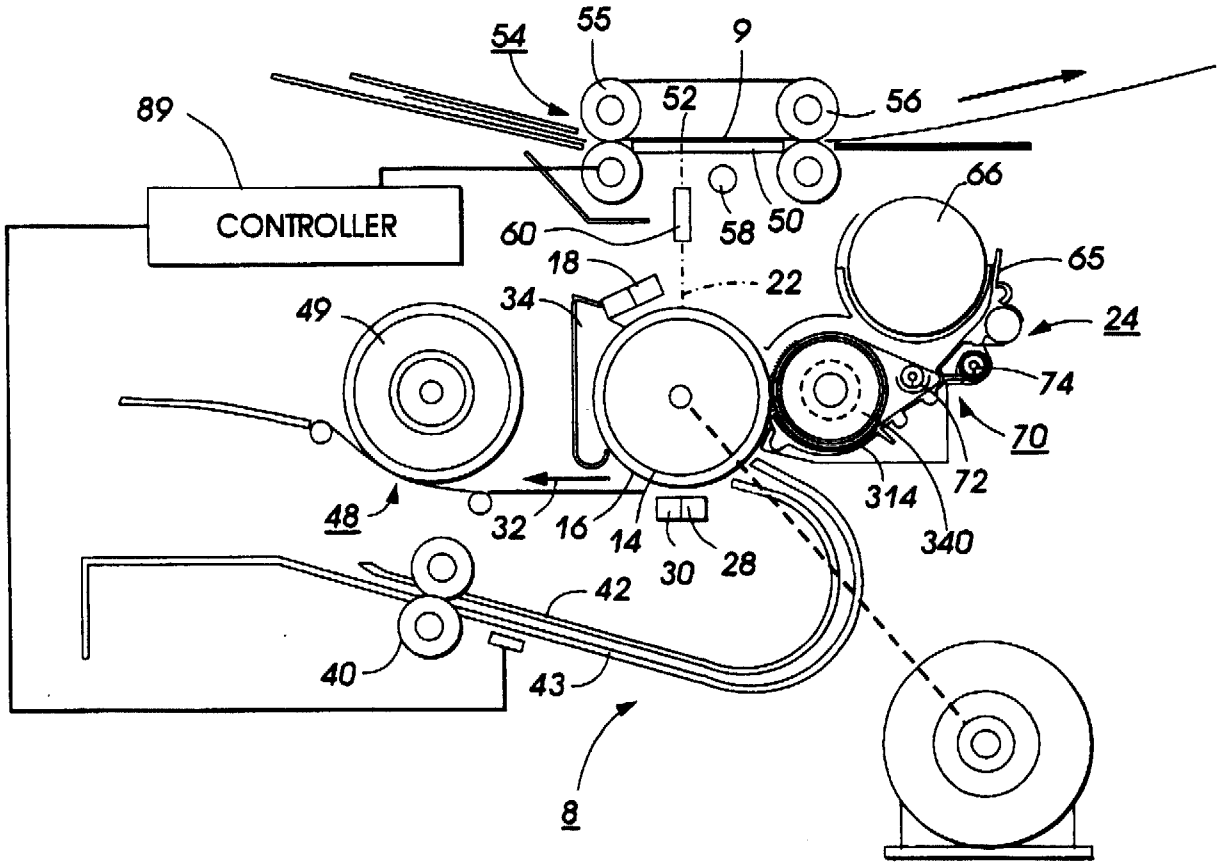
FIG. 1 is a side view, is section, of a xerographic reproduction machine incorporating the magnetic brush developer of the present invention.

Referring to FIG. 1 of the drawings, there is shown a xerographic type reproduction machine 8 incorporating the magnetic brush of the present invention, designated generally by the numeral 80. Machine 8 has a suitable frame (not shown) on which the machine xerographic components are operatively supported. Briefly, and as will be familiar to those skilled in the art, the machine xerographic components include a recording member, shown here in the form of a rotatable photoreceptor 14. In the exemplary arrangement shown, photoreceptor 14 comprises a drum having a photoconductive surface 16. Operatively disposed about the periphery of photoreceptor 14 are a charge corotron 18 for placing a uniform charge on the photoconductive surface 16 of photoreceptor 14; an exposure station 22 where the previously charged photoconductive surface 16 is exposed to image rays of a document 9 being copied or reproduced; development station 24 where the latent electrostatic image created on photoconductive surface 16 is developed by toner; and transfer detack corotrons 28 and 30 for assisting transfer of the developed image to a suitable copy substrate material such as a copy sheet 32 brought forward in timed relation with the developed image on photoconductive surface 16. Residual toner is removed from the drum surface at cleaning station 34.

Copy sheets 32 are brought forward to the transfer area by feed roll pair 40, sheet guides 42, 43 serving to guide the sheet through an approximately 180° turn prior to the transfer area. Following transfer, the sheet 32 is carried forward to a fusing station 48 where the toner image is fixed by fusing roll 49. After fusing, the copy sheet 32 is discharged to an output tray.

A transparent platen 50 supports the document 9 as the document is moved past a scan point 52 by a constant velocity type transport 54. As will be understood, scan point 52 is in effect a scan line extending across the width of platen 50 at a desired point along the platen where the document is scanned line by line as the document is moved along platen 50 by transport 54. Transport 54 has input and output document feed roll pairs 55, 56, respectively, on each side of scan point 52 for moving document 9 across platen 50 at a predetermined speed. Exposure lamp 58 is provided to illuminate a strip-like area of platen 50 at scan point 52. The image rays from the document line scanned are transmitted by a gradient index fiber lens array 60 to exposure station 22 to expose the photoconductive surface 16 of the moving photoreceptor 14.

Developer station 24 includes a developer housing 65 in which a toner dispensing cartridge 66 is rotatably mounted so as to dispense toner particles downward into a sump area occupied by the dual auger mixing assembly 70. Assembly 70 includes a pair of rotatably mounted augers 72 and 74.

Continuing with the description of the developing station 24, a magnetic brush developer roll 340 is disposed in predetermined operative relation to the photoconductive surface 16 of photoreceptor 14, the length of developing roll 340 being equal to or slightly greater than the width of photoconductive surface 16, with the axis of roll 340 parallel to the axis of photoreceptor 14. Rotation of sleeve 314 carries the developer brush into developing relation with the photoconductive surface 16 of photoreceptor 14 to develop the latent electrostatic image therein.

A suitable controller 89 is provided for operating the various components of machine 8 in predetermined relation with one another to produce copies. In operation, machine 8 is actuated by a suitable start control button. The document to be copied is then inserted into the nip of document transport roll pair 55, 56 which carries the document across platen 50. As the leading edge of the document reaches a detector, controller 89, in response to the signal from the detector, starts feed roll pair 40 to advance the copy sheet 32 forward in timed relation with the document 9 as the document is transported across platen 50 and past scan point 52 by document transport 54. The document image developed on the photoconductive surface 16 of photoreceptor 14 is transferred to copy sheet 32 as the copy sheet moves through the transfer area. Following transfer, the copy sheet 32 passes to fusing station 48 where the image is fixed.

The present invention employs two substantially identical molds which only differ in that the diameter of their inner cavity, for illustrative purposes only one mold will be described in detail. Preferably the molds used in the present invention are of the type disclosed in U.S. application Ser. No. 08/752,106, entitled "INJECTED MOLDED MAGNETIC ROLLER MOLD CAVITY WITH REPLACEABLE INSERTS" which is hereby incorporated by reference. The molding machine may be any suitable molding machine capable of receiving moldable material and may be, for example, Model No. 600/200 VHRO provided by Engel Company, Guelph, Canada.

Figure 2:
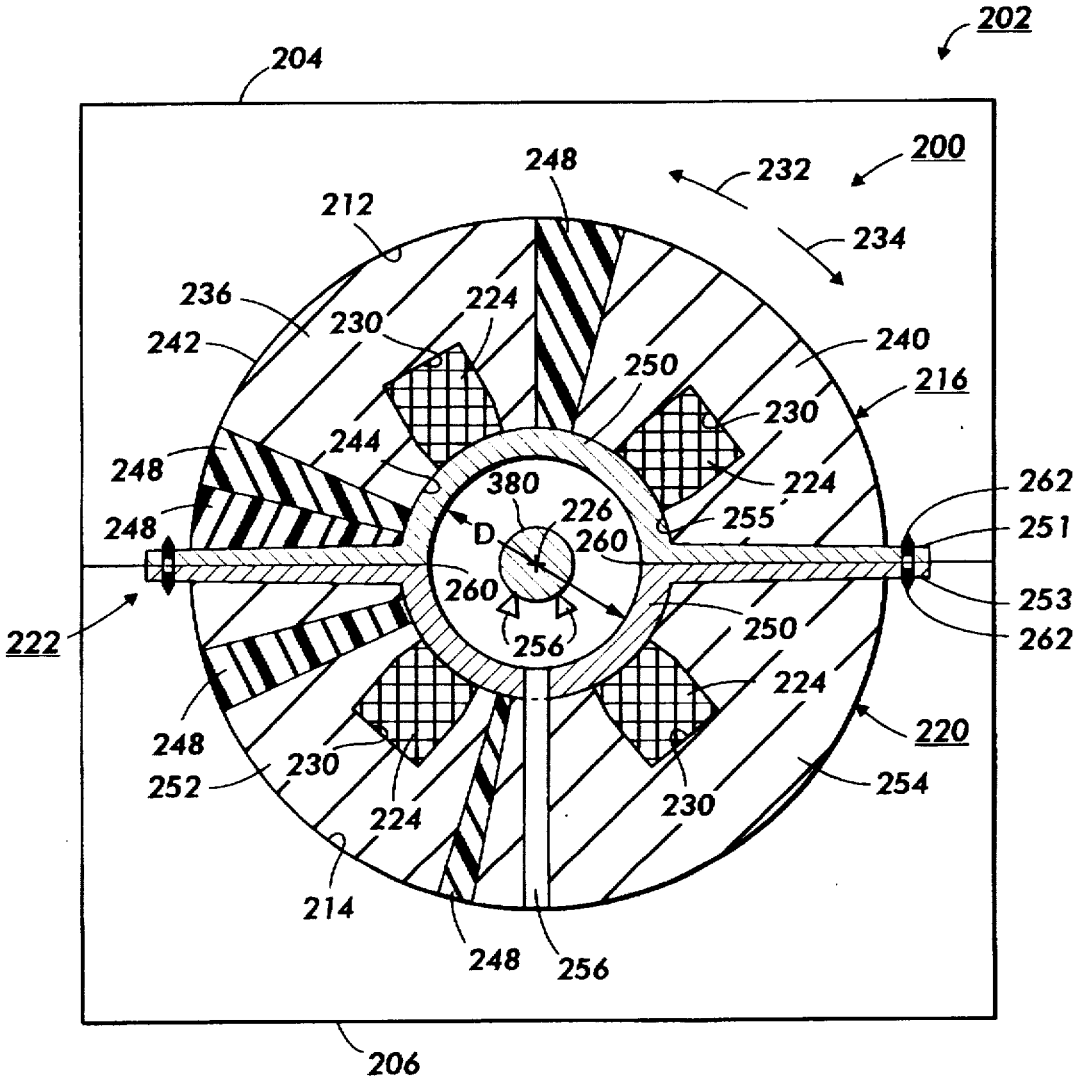
FIG. 2 is an enlarged side view of a mold employed to make developer roll shown in FIG. 1.

Referring now to FIG. 2, mold 200 may be separated into two portions so that the roll may be easily removed between the portions of the mold 200. The mold 200 is supported by mold support 202. Mold support 202 includes a stationary mold support 204 as well as an ejector mold support 206. The stationary mold support 204 and the ejector mold support 206 may have any shape suitable for supporting the mold 200. For example, the stationary mold support 204 and the ejector mold support 206 may combine to have a generally rectangular shape as well as a generally uniform cross-section. The stationary mold support 204 and the ejector mold support 206 combine to form aperture 210 to which the mold 200 matingly fits. The aperture 210 may have any suitable shape, but for simplicity and particularly when used to mold circular cross-section parts, the aperture 210 is formed from two (2) generally semi-circular portions 212 and 214 in the stationary mold support 204 and the ejector mold support 206, respectfully.

To permit the easy removal of the roll from the mold 200, the mold 200 includes two (2) separate portions, a first mold portion 216 in the form of a stationary mold and second mold portion 220 in the form of an ejector mold. The stationary mold 216 and the ejector mold 220 are made of any suitable durable material. For example, the stationary mold and ejector mold, 216 and 220, respectfully, are made from a metal alloy, for example, copper and beryllium.

To accommodate the abrasive wear caused by the ferrite material used to mold the magnetic roll, the mold 200 also includes an insert 222. The insert 222 is positioned between the stationary mold 216 and the ejector mold 220. As molding the magnetic rolls may cause wear to the insert 222, replacement inserts may be used to replace a worn insert with a new insert.

To provide a magnetic field to magnetize the material used to make the magnetic roll, the mold 200 preferably includes a permanent magnetic member 224. The magnetic member 224 may have any suitable shape, but as shown in FIG. 2, the magnetic member preferably has a generally rectangular shape and extends in a direction generally parallel to centerline 226 of the mold 200. The magnetic member 224 may be made of any suitable durable material, for example Samariam Cobalt manufactured by Magnet Sales and Manufacturing. To secure the magnetic members 224 within the mold 200, preferably, the magnetic members are positioned in a pocket 230 within the mold 200. The pocket 230 generally conforms to the magnetic member 224.

While magnetic members may be manufactured with a solitary magnetic pole, preferably, the magnetic member includes a plurality of magnetic poles. For example, the magnetic roll of FIG. 4A has two (2) north poles and two (2) south poles. Referring again to FIG. 2, to generate a magnetic roll with two (2) north and two (2) south poles, the mold 200 includes four (4) magnetic members 224. As stated earlier, the relative position of the magnetic members 224 with respect to the periphery of the roll effects the operation of the transfer of the toner from the developer unit to the photoreceptor. Since it is very difficult to isolate the magnetic fields of the magnetic members 224, the magnetic members 224 interact with each other creating a positional shift in the resulting magnetic field of the roll that is molded in the mold 200 relative to the position of the magnetic member 224. It becomes, therefore, very difficult to position the magnetic members 224 in a proper position to accomplish a roll with magnetic fields in certain precise positions. For example, the applicants have found that the actual magnetic fields of a molded part may be as much as 10 degrees of angularity different than the respective centerlines of the magnetic members within the mold 200. It thus becomes advantageous to be able to position the magnetic members 224 about the mold 200 in order to provide an accurate positioning of the magnetic poles of the roll.

The applicants have found that it is desirable to permit the magnetic members 224 to be rotatably positionable in the direction of first arrow 232 and second arrow 234 to accurately position the poles of the magnetic roll. To permit the rotation of the magnetic members 224 in the direction of arrows 232 and 234, preferably, the stationary mold 216 includes a stationary mold first mold segment 236 and a stationary mold second mold segment 240. The mold segments 236 and 240 are rotatably positionable about mold centerline 226.

The rotatable position of the stationary mold first mold segment 236 is accomplished by a first mold arcuate portion 242 about the outer-periphery of the segment 236 and second mold arcuate portion 244 about the inner periphery of the first mold segment 236. The first mold arcuate portion 242 and the second mold arcuate portion 244 have a centerline coincident with the mold centerline 226. Likewise, the stationary mold support 204 defines the semi-circular portion 212 which conforms to the first mold arcuate portion 242. Likewise, the insert 222 includes an insert arcuate portion 250, preferably a semi-circular portion, which conforms to the second mold arcuate portion 244. The first mold segment 236 and second mold segment 240 include magnetic pockets 230 into which the magnetic members 224 are matingly fitted. The magnetic members 224 may thus be rotatably positioned about the mold 200.

To secure the segments 236 and 240 in position, wedges 248 are positioned between adjacent segments 236 and 240 and between the stationary mold support and the insert 222. The wedges 248 may have different widths depending on the distance between and positions of adjacent segments 236 and 240.

Similar to the stationary mold first mold segment 236 and stationary mold second segment 240, preferably, the ejector mold 220 includes an ejector mold first mold segment 252 and an ejector mold second mold segment 254. Similar to the segments 236 and 240, the segments 252 and 254 include magnetic pockets 230 to which the magnetic members 224 are secured. The ejector mold first mold segment 252 and second mold segment 254 are, likewise, rotatably positioned about mold centerline 226 and are held in position by wedges 248.

To provide for the ejection of the molded magnetic roll from the mold 200, ejector pins 256 are preferably provided to physically separate the magnetic member from the ejector mold 220. The ejector pins 256 are preferably centrally located within the second mold portion 220.

Figure 3:
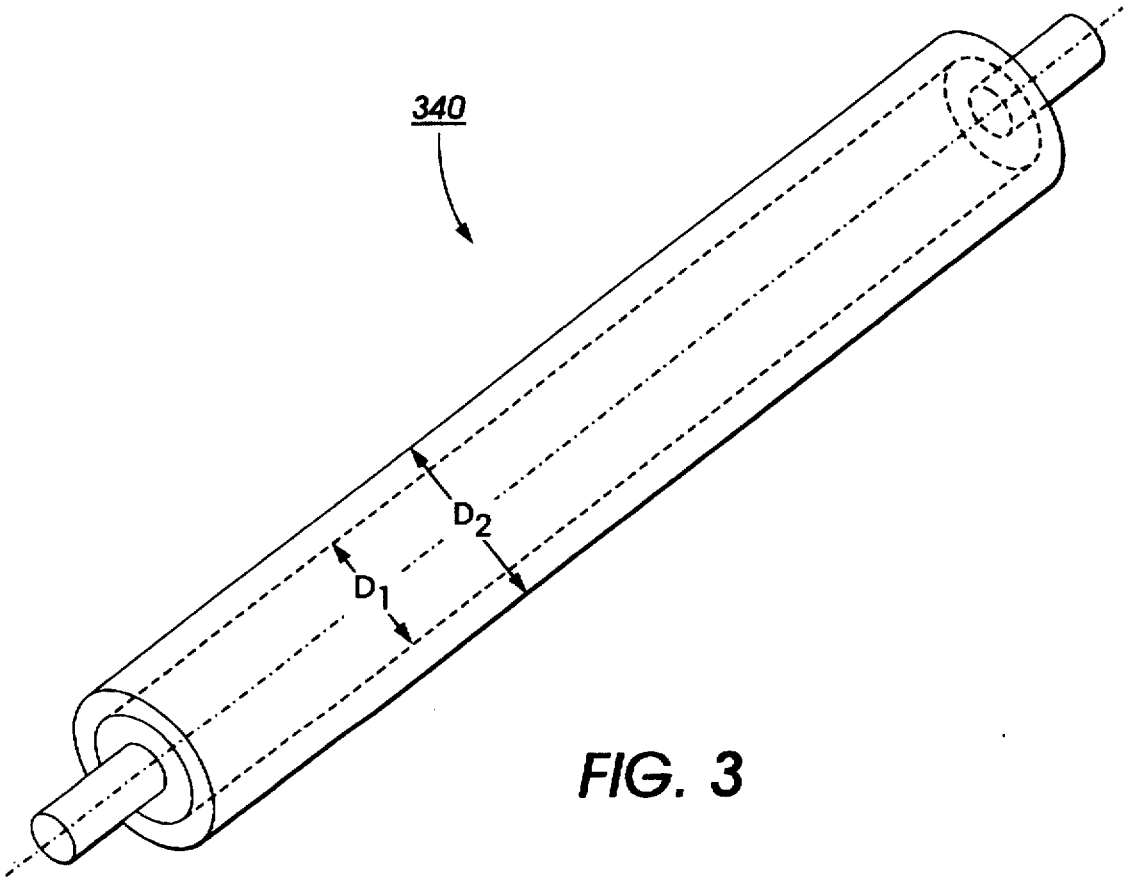
FIGS. 3, 4, 4A and 5 are views of the developer roll of the present invention.

The insert 222 for the mold 200 preferably includes a stationary cover plate 251 secured to the first mold portion 216 and an ejector cover plate 253 secured to the second mold portion 220. The ejector cover plate 253 and the stationary cover plate 251 are made of any suitable durable material. Preferably, the plates 251 and 253 are made of a non-magnetic metal, for example beryllium-copper. The plates 251 and 253 have the semi-circular portion 250 which forms an inner periphery of the mold 200. The inner periphery 255 of the mold 200 defines a diameter "D1" (as shown in FIG. 3) which is roughly equal to the outside diameter of the magnetic roll after the first molding operation.

The plates 251 and 253 may each be made of a unitary piece. Alternatively the plates 251 and 253 may be made in strips each having a cross section as shown in FIG. 2. If the plates are for example 15 inches long along the centerline 226, the plate segments (not shown) may extend for five inches each. Adjacent segments would then be butted against each other. The segments would allow for smaller components to grind than a unitary design would allow. The smaller components would permit more accurate and flatter grinding of the flat portions of the plates 251 and 253, permitting less material to pass at parting line 260.

Supports 256 are positioned at the opposed ends of the mold 200. The supports 256 serve to support the magnetic roll. The portions of the plates 251 and 253, where the plates 251 and 253 contact at the circular portion 250, define a parting line 260. The parting line 260 represents the critical wear portion of the insert 222. As the parting line 260 wears, a protrusion or raised area forms on the periphery of the magnetic roll. This protrusion or raised area requires subsequent machining. It is therefore important to keep the insert 222 in good condition so that the parting line protrusion may be minimized. The insert 222 may be easily replaced maintaining the like-new condition of the parting line 260.

The cover plates 251 and 253 are secured to the stationary mold support 204 and the ejector mold support 206, respectively. The plates 251 and 253 may be secured in any suitable method such as by gluing, rivets, but preferably are removably secured by fasteners, in the form of screws 262.

Figure 4:
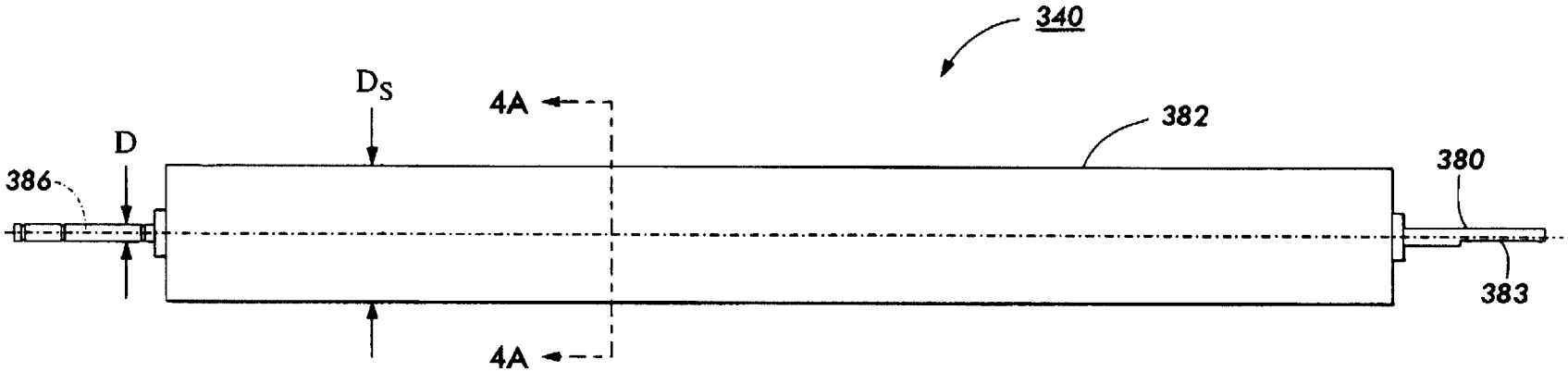

Referring again to FIG. 4, the shaft 380 is made of any suitable durable material capable of supporting the core 382. For example, the shaft may be made of a metal. To avoid having the shaft attracted to the permanent magnets and to the carrier granules, the metal is preferably a non-magnetic material. An example of such a suitable material is SUS 303. The shaft may have any shape, but typically has a cylindrical shape having a diameter D of sufficient size to be capable of supporting the core 382. The shaft 380 preferably has a feature for angularly orienting the position of the magnet poles in the roll with the shaft 380. For example the shaft includes a "D" flat 383 which mates with a mating feature (not shown) on the mold 200. The "D" flat 383 serves to provide an absolute magnetic pole location for the core 382 with respect to the shaft 380 in the mold and to provide an absolute magnetic pole location for the core 382 with respect to the shaft 380 when assembled into the developer unit.

The core 382 is positioned about shaft 380. The core 382 is preferably molded onto the shaft 380. The core 382 has a diameter $D_S$ of approximately 13 mm for a development roll 300 (see FIG. 5) having a diameter of approximately 18 mm. The core 382 has a centerline which is coincident with centerline 386 of shaft 380. While the invention is shown with a single pair of north and south poles, the magnetic roll may include a plurality of poles.

Figure 4A:
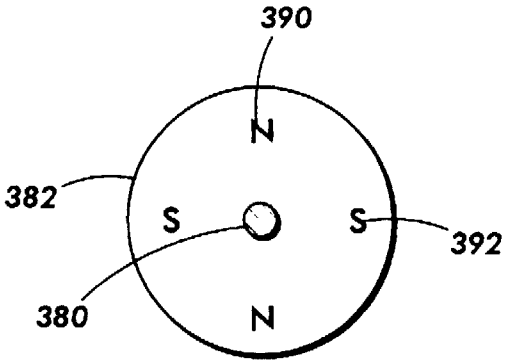

For example, referring to FIG. 4A, the magnetic roll includes two (2) spaced-apart north poles 390 and separated by two (2) spaced-apart south poles 392. As stated earlier, the relative position of the north poles 390 and the south poles 392 may be altered by rotating the position of the mold segments 236 and 230 (see FIG. 2).

Referring again to FIG. 4, the core 382 may be made of any suitable, durable, moldable material. For example, the core material may be a polyester, a nylon, an acrylic, a urethane, or an epoxy. The core material may be made of any castable resin that is castable at low pressures. This core material may be fortified with fillers, for example, milled glass, glass fibers, conductive fillers, or reinforcements. Preferably, the core 382 includes ferrite material which is magnetizable. Suitable ferrite filled resin material for use with the present invention are known, for example 5,319,337 which is incorporated by reference discloses a suitable ferrite filled resin material.

A magnetic roll of the present invention is manufactured by mold 200 of FIG. 2. The magnetic roll 240 includes a core 382 positioned about a shaft 380. As stated earlier, the shaft 380 is placed in the mold 200 (see FIG. 2) against supports 256 and the core 382 is molded with ferrite filled resin material about the shaft 380 to a first diameter "D1" the diameter D1 is typically about 9 mm. The permanent magnets positioned around the cavity to orient and magnetize the core 382 to a desired magnetic saturation level which is typically 1000–800Gauss measured from 2 mm surfaces. Then the ferrite filled resin material is allow to cool until it solidifies.

Figure 6:
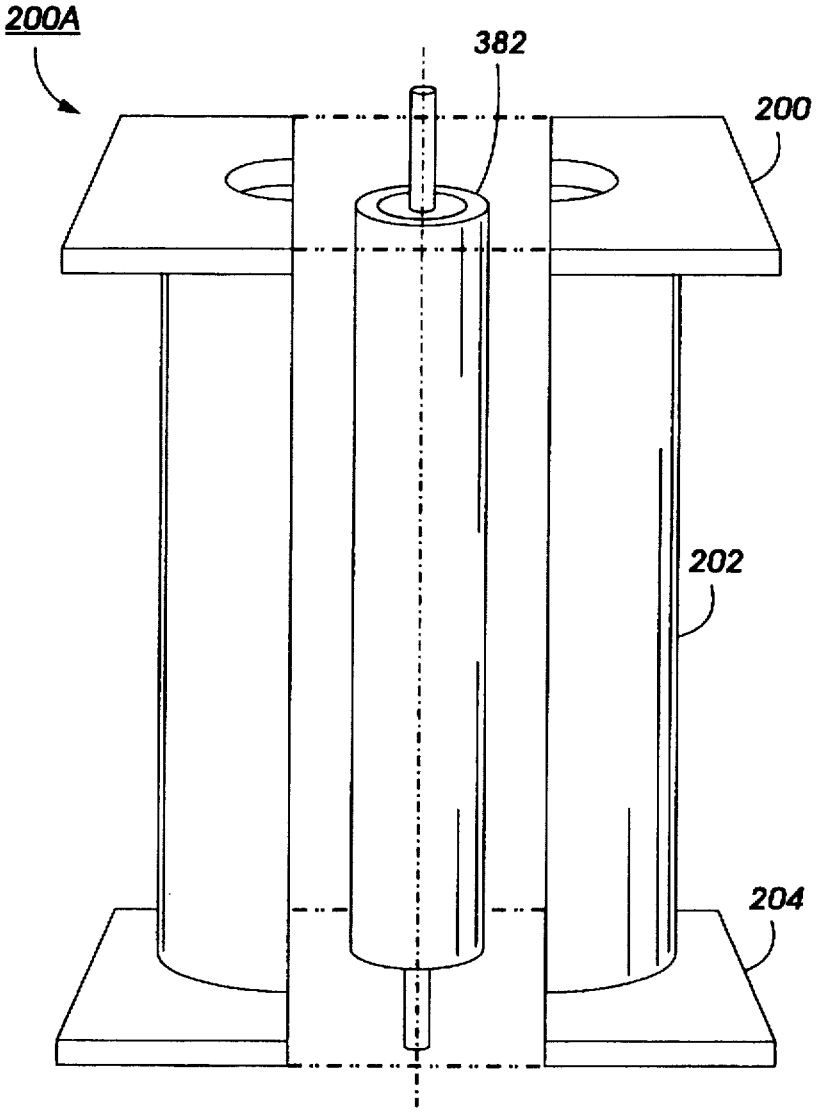
FIG. 6 illustrate the overmolding step in the manufacturing process of the developer roll of the present invention.

The roll is removed from mold 200 and is put into mold **200*a* as shown in FIG. 6. Mold 200*a* is identical to mold 200 except that the inner periphery of the mold 200 defines a diameter "D2" which is roughly equal to the outside diameter of the magnetic roll. The second diameter "D2" the diameter D1 is typically about 13 mm. Core 382 is molded with ferrite filled resin material about the shaft 380 to the second diameter "D2". The permanent magnets are positioned around the cavity to orient and magnetize the core 382 to a desired saturation level which is typically 1000–800Gauss measured from 2 mm surfaces. Then the ferrite filled resin material is allow to cool until it solidifies. Preferably, the roll is positioned in mold 200***a* so that permanent magnets are positioned around the cavity have the same orientation as the magnets positioned in mold 200.

It should be not that the ferrite filled resin material during the first molding operation could have a higher or lower ferrite concentration in the ferrite filled resin material than the ferrite filled resin material used in the second molding operation.

Figure 5:
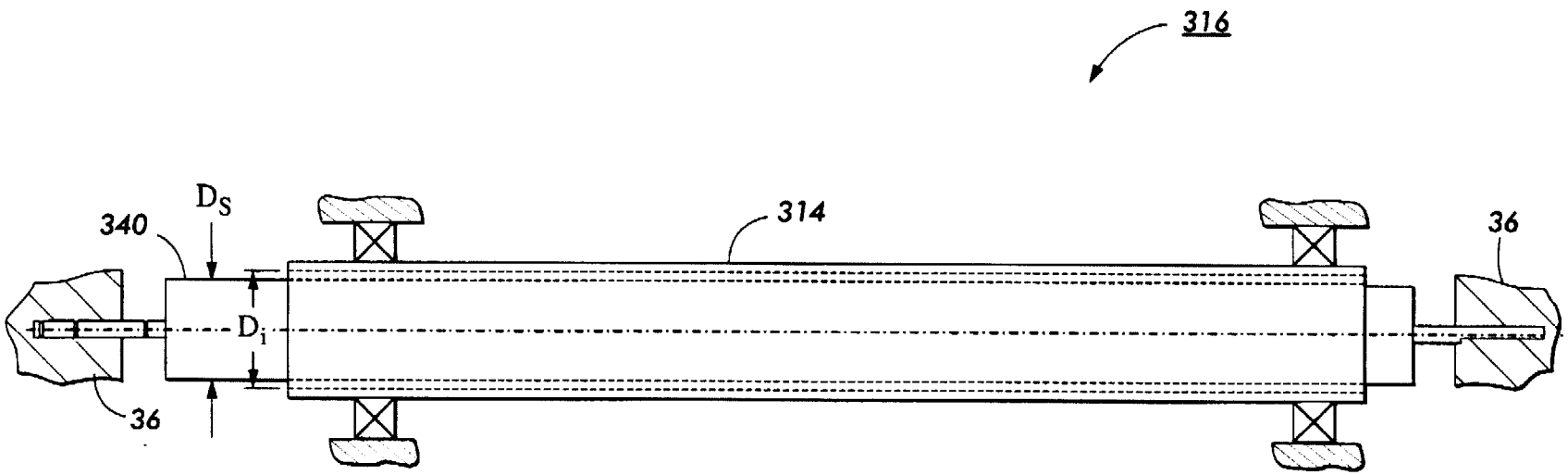

Referring now to FIG. 5, the completed magnetic roll 380 is shown assembled within a sleeve or tube 314 to form the developer roll 316. The tube 314 may be made of any suitable, durable, non-peril magnetic material, for example, aluminum or plastic.

The tube 314 has an inner diameter "$D_i$" which is slightly larger than the diameter "$D_s$" of the magnetic roller. The tube 314 and the magnetic roller serve to form the developer roll 316 which is typically an assembly. The magnetic roll 316 may operate by either a stationary tube 114 having a rotating magnetic roll located therein, or by having a rotating tube 314 rotating about a fixed magnetic roll. Preferably, however, the magnetic roll is fixed. The tube 314 is rotatably secured to the developer housing 36 and is driven by a power source (not shown) in an appropriate direction to advance toner to the photoreceptor. The magnetic roll thus advances the developer material around the periphery of the tube 314 toward the photoreceptive surface of the drum.

Applicants have found that a roll made by the process of the present invention will produce a magnet roller with a higher flux density than roll produced in a single mold process because it is believed that when employing the present invention the inner layers and outer layer have reached magnetic saturation for any given magnetic powder concentration.

While the invention has been described with reference to the structure disclosed, it is not confined to the specific details set forth, but is intended to cover such modifications or changes as may come within the scope of the following claims.

What is claimed is:

1. A method for manufacturing a magnetic roll, comprising the steps of:

molding a roll core with molten magnetic powder filled resin material to a first diameter in a first mold;

magnetizing said core during said molding step;

allowing the molten magnetic powder filled resin material to cool until it solidifies;

overmolding said roll core with molten magnetic powder filled resin material to a second diameter in a second mold;

magnetizing said core during said overmolding step; and allowing the molten magnetic powder filled resin material to cool until it solidifies.

2. The method of claim 1, further comprising the steps of:

magnetizing and orienting the magnetic particles in the molten resin during the molding step.

3. The method of claim 2, further comprising the steps of:

magnetizing and orienting the magnetic particles in the molten resin during the overmolding step.

4. The method of claim 2, wherein said magnetizing and orienting step comprises the step of placing permanent magnets about said core.

5. The method of claim 1, further comprising the steps of:

magnetizing and orienting the magnetic particles in the magnetic powder filled resin material during the overmolding step.

6. The method of claim 1, further comprising the steps of:

enclosing said core with a sleeve.

* * * * *